US009097255B2

(12) United States Patent
Kobayashi et al.

(10) Patent No.: US 9,097,255 B2
(45) Date of Patent: Aug. 4, 2015

(54) COMPRESSED GAS SUPPLY UNIT

(71) Applicant: ANEST IWATA CORPORATION, Yokohama-shi, Kanagawa-ken (JP)

(72) Inventors: Kenichi Kobayashi, Yokohama (JP); Atsushi Unami, Yokohama (JP)

(73) Assignee: ANEST IWATA CORPORATION, Kanagawa-Ken (JP)

( * ) Notice: Subject to any disclaimer, the term of this patent is extended or adjusted under 35 U.S.C. 154(b) by 309 days.

(21) Appl. No.: 13/849,635

(22) Filed: Mar. 25, 2013

(65) Prior Publication Data

US 2013/0287592 A1 Oct. 31, 2013

(30) Foreign Application Priority Data

Apr. 27, 2012 (JP) ..... 2012-104136

(51) Int. Cl.

| | |
|---|---|
| ***F04C 28/08*** | (2006.01) |
| ***F04B 49/20*** | (2006.01) |
| ***F04C 23/00*** | (2006.01) |
| ***F04C 11/00*** | (2006.01) |
| ***F04C 28/02*** | (2006.01) |
| ***F04C 18/02*** | (2006.01) |
| *F04B 49/08* | (2006.01) |
| *F04B 23/04* | (2006.01) |
| *F04C 14/02* | (2006.01) |
| *F04B 49/00* | (2006.01) |

(52) U.S. Cl.

CPC ..... *F04C 23/001* (2013.01); *F04B 49/20* (2013.01); *F04C 11/001* (2013.01); *F04C 18/0207* (2013.01); *F04C 28/02* (2013.01); *F04C 28/08* (2013.01); *F04B 23/04* (2013.01); *F04B 49/00* (2013.01); *F04B 49/08* (2013.01); *F04C 14/02* (2013.01); *F04C 2240/403* (2013.01); *F04C 2270/0525* (2013.01)

(58) Field of Classification Search

CPC ..... F04B 23/04; F04B 49/00; F04B 49/20; F04B 49/08; F04C 11/00; F04C 14/02

See application file for complete search history.

(56) References Cited

U.S. PATENT DOCUMENTS

| | | | | |
|---|---|---|---|---|
| 6,419,454 | B1 * | 7/2002 | Christiansen | 417/4 |
| 7,207,183 | B2 * | 4/2007 | Crane et al. | 62/175 |
| 7,953,533 | B2 * | 5/2011 | Tsuda | 701/51 |
| 2004/0265133 | A1 * | 12/2004 | Lau | 417/7 |
| 2011/0129355 | A1 * | 6/2011 | Hofseth et al. | 417/5 |

FOREIGN PATENT DOCUMENTS

| | | | |
|---|---|---|---|
| JP | 11343986 | A | 12/1999 |
| JP | 2010190197 | A | 9/2010 |

* cited by examiner

*Primary Examiner* — Christopher Bobish

(74) *Attorney, Agent, or Firm* — Lowe Hauptman & Ham, LLP

(57) ABSTRACT

A compressed gas supply unit has scroll compressors. Gas discharged from the scroll compressors travels through a main supply passage and is reserved in a reservoir tank, after which the gas is supplied to a gas recipient from a supply passage. The scroll compressors include inverter devices that allow for independent modulation of the speeds of respective drive motors. The controller includes a speed range setting unit that sets an upper speed limit and a lower speed limit of the scroll compressors, a speed sum calculating unit that calculates a sum of speeds of the scroll compressors based on a load of the compressed gas supply unit, and a speed setting unit that allocates the calculated sum of speeds among the scroll compressors to set speeds for scroll compressors respectively.

4 Claims, 4 Drawing Sheets

Fig. 2

(A)

| | | | | | | | | | | | | | | | | |
|---|---|---|---|---|---|---|---|---|---|---|---|---|---|---|---|---|
| VARIABLE SPEED + START/STOP CONTROL OF PLURAL UNITS (PRESENT INVENTION) | SPEED | 1st UNIT 14a | % | 0 | 0 | 0 | 0 | 0 | 0 | 0 | 0 | 30 | 50 | 70 | 90 | 100 |
| | | 2nd UNIT 14b | | 0 | 0 | 0 | 0 | 30 | 50 | 70 | 90 | 100 | 100 | 100 | 100 | 100 |
| | | 3rd UNIT 14c | | 30 | 50 | 70 | 90 | 100 | 100 | 100 | 100 | 100 | 100 | 100 | 100 | 100 |
| | | OVERALL | | 10 | 17 | 23 | 30 | 43 | 50 | 57 | 63 | 77 | 83 | 90 | 97 | 100 |
| | SPECIFIC ENERGY | 1st UNIT 14a | J/L | 0 | 0 | 0 | 0 | 0 | 0 | 0 | 0 | 1200 | 1000 | 800 | 600 | 500 |
| | | 2nd UNIT 14b | | 0 | 0 | 0 | 0 | 1200 | 1000 | 800 | 600 | 500 | 500 | 500 | 500 | 500 |
| | | 3rd UNIT 14c | | 1200 | 1000 | 800 | 600 | 500 | 500 | 500 | 500 | 500 | 500 | 500 | 500 | 500 |
| | | OVERALL | | 1200 | 1000 | 800 | 600 | 662 | 667 | 624 | 547 | 591 | 600 | 578 | 531 | 500 |

(B)

| | | | | | | | | | |
|---|---|---|---|---|---|---|---|---|---|
| SPEED CONTROL OF SINGLE UNIT (CONVENTIONAL METHOD) | SPEED | % | 30 | 40 | 50 | 60 | 70 | 80 | 100 |
| | SPECIFIC ENERGY | J/L | 1200 | 1100 | 1000 | 900 | 800 | 700 | 500 |

(C)

| | | | | | | | | | | | | | | | | |
|---|---|---|---|---|---|---|---|---|---|---|---|---|---|---|---|---|
| VARIABLE SPEED CONTROL ONLY OF PLURAL UNITS (COMPARATIVE EXAMPLE) | SPEED | 1st UNIT 14a | % | 30 | 30 | 30 | 30 | 30 | 30 | 30 | 30 | 30 | 50 | 70 | 90 | 100 |
| | | 2nd UNIT 14b | | 30 | 30 | 30 | 30 | 30 | 50 | 70 | 90 | 100 | 100 | 100 | 100 | 100 |
| | | 3rd UNIT 14c | | 30 | 50 | 70 | 90 | 100 | 100 | 100 | 100 | 100 | 100 | 100 | 100 | 100 |
| | | OVERALL | | 30 | 37 | 43 | 50 | 53 | 60 | 67 | 73 | 77 | 83 | 90 | 97 | 100 |
| | SPECIFIC ENERGY | 1st UNIT 14a | J/L | 1200 | 1200 | 1200 | 1200 | 1200 | 1200 | 1200 | 1200 | 1200 | 1000 | 800 | 600 | 500 |
| | | 2nd UNIT 14b | | 1200 | 1200 | 1200 | 1200 | 1200 | 1000 | 800 | 600 | 500 | 500 | 500 | 500 | 500 |
| | | 3rd UNIT 14c | | 1200 | 1000 | 800 | 600 | 500 | 500 | 500 | 500 | 500 | 500 | 500 | 500 | 500 |
| | | OVERALL | | 1200 | 1109 | 985 | 840 | 763 | 756 | 710 | 636 | 591 | 600 | 578 | 531 | 500 |

Fig. 4

$MV_{min}=1000$ , $MV_{max}=3000$

| OVERALL SPEED | ALLOCATION | | |
|---|---|---|---|
| | 1st UNIT 14a | 2nd UNIT 14b | 3rd UNIT 14c |
| MV [min$^{-1}$] | $MV_1$ [min$^{-1}$] | $MV_2$ [min$^{-1}$] | $MV_3$ [min$^{-1}$] |
| 0 | 0 | 0 | 0 |
| 100 | 0 | 0 | 0 |
| 900 | 0 | 0 | 0 |
| 1000 | 1000 | 0 | 0 |
| 1500 | 1500 | 0 | 0 |
| 2000 | 2000 | 0 | 0 |
| 2500 | 2500 | 0 | 0 |
| 3000 | 3000 | 0 | 0 |
| 3500 | 2500 | 1000 | 0 |
| 4000 | 3000 | 1000 | 0 |
| 4500 | 3000 | 1500 | 0 |
| 5000 | 3000 | 2000 | 0 |
| 5500 | 3000 | 2500 | 0 |
| 6000 | 3000 | 3000 | 0 |
| 6500 | 3000 | 2500 | 1000 |
| 7000 | 3000 | 3000 | 1000 |
| 7500 | 3000 | 3000 | 1500 |
| 8000 | 3000 | 3000 | 2000 |
| 8500 | 3000 | 3000 | 2500 |
| 9000 | 3000 | 3000 | 3000 |

COMPRESSED GAS SUPPLY UNIT

RELATED APPLICATIONS

The present application is based on, and claims priority from, Japanese Application Number 2012-104136, filed Apr. 27, 2012, the disclosure of which is hereby incorporated by reference herein in its entirety.

BACKGROUND OF THE INVENTION

1. Field of the Invention

The present invention relates to a compressed gas supply unit having a plurality of scroll compressors and capable of maintaining stable operation even under frequently changing loads.

2. Description of the Related Art

If a compressed gas supply unit has only one compressor, the compressed gas supply unit may become unable to produce and supply compressed gas to a gas recipient, should a failure occur in this one compressor. Thus, compressed gas supply units having a plurality of compressors which are capable of controlling the number of compressors under operation in accordance with the load (demand for compressed gas) to supply compressed gas as required by the gas recipient are known. Such compressed gas supply units achieve energy savings by controlling and minimizing the number of compressors under operation.

Japanese Patent Application Laid-open No. 2010-190197 discloses a compressed gas supply unit including a common reservoir tank for reserving gas discharged from a plurality of compressors, and a pressure sensor for detecting the pressure in the reservoir tank, wherein the number of compressors under operation is controlled in accordance with changes in the amount of consumed gas, which are determined from measurements by the pressure sensor of the pressure in the reservoir tank.

Conventional compressed gas supply units having a plurality of compressors can supply compressed gas to the gas recipient at a level required by the gas recipient by maintaining the pressure in the merge pipe on the discharge side of the compressors or the reservoir tank in accordance with load change (demand for compressed gas) at the required level. Thus, inverter devices that allow variation of compressor speed are provided. The inverter devices modulate the speeds of the compressors and adjust the pressure on the discharge side of the compressors to the level required by the gas recipient. One problem here is power consumption which increases because of poor efficiency caused by low speed operation, which is necessary to adapt to low load of the compressed air supply units.

Japanese Patent Application Laid-open No. H11-343986 discloses a compressed air production apparatus, having a plurality of motor-driven screw compressors arranged in parallel rows, and the respective discharge air systems merged into one pipe or air tank. This compressed air production apparatus includes an inverter device that allows for variable speed modulation of the motors for the respective screw compressors, a pressure sensor provided in the merge pipe or air tank, and a controller that controls the plurality of screw compressors to keep the pressure detected by the pressure sensor within a range of predetermined upper and lower pressure limits. The controller controls to operate only one of the plurality of screw compressors at varying speeds by means of the inverter device, while other screw compressors are either operated under full load conditions, or stopped. Thereby this compressed air production apparatus reduces power consumption, as making it substantially linearly proportional to the amount of air being used.

The compressed air production apparatus disclosed in Japanese Patent Application Laid-open No. H11-343986 enables a reduction in power consumption as compared to simple speed modulation of a plurality of compressors. However, under frequently changing loads, the apparatus is not capable of modulating the speeds of the respective compressors immediately in response to a load change to stably maintain the discharge pressure of the compressors at a level required by the gas recipient.

Scroll compressors offer merits of small size, light weight, low vibration and noise, lower in component count, and ease of production, and have found wide applications as small compressors in vehicle air conditioning compressor, superchargers, and the like. The scroll compressors can promptly react to frequent load changes by being used in combination with inverter devices, as their speed-torque characteristics are suited to variable speed drive by inverter devices.

SUMMARY OF THE INVENTION

In view of the problems in the conventional techniques, an object of the present invention is to allow for prompt reaction to frequent load changes to enable stable adjustment of the discharge pressure of compressed gas to a level required by a gas recipient and reduction of power consumption, in a compressed gas supply unit with a multiple compressor system that uses scroll compressors.

The compressed gas supply unit of the present invention includes a plurality of scroll compressors, an inverter device allowing independent modulation of speeds of the respective scroll compressors, a merge pipe or a reservoir tank for collecting gas discharged from the plurality of scroll compressors, a pressure sensor that detects discharge pressure of the plurality of scroll compressors, and a controller that controls the inverter device for modulating the speeds of the respective scroll compressors.

The controller includes a speed range setting unit that sets an upper speed limit and a lower speed limit of the plurality of scroll compressors, a calculating un it that calculates a sum of speeds of the plurality of scroll compressors based on a load of the compressed gas supply unit, and a speed setting unit that allocates the calculated sum of speeds among the scroll compressors to set speeds for the respective scroll compressors.

The speed range setting unit sets an upper speed limit of the scroll compressors to exclude speeds at which the motors that drive the scroll compressors will be overloaded and cannot run correctly. A lower speed limit is also set so as to exclude low speeds at which the specific energy (power consumption/discharge volume) becomes extremely large. The calculating unit calculates the sum of speeds of the plurality of scroll compressors based on the load of the compressed gas supply unit, and the speed setting unit allocates the calculated sum of speeds among the scroll compressors to set the speeds for the respective scroll compressors.

Thereby, the speeds of the scroll compressors can be kept within a range where they run correctly with low power consumption. Also, as the speed of each scroll compressor can be set in an early stage adapted to the load of the compressed gas supply unit, the discharge pressure of the compressed gas can be adjusted promptly to a desired level for the gas recipient in a stable manner.

When the sum of speeds calculated by the calculating unit is lower than a sum of upper speed limits of all the scroll compressors, the speed setting unit reduces the speed of a first scroll compressor by a difference between the calculated sum of speeds and the sum of upper speed limits, and sets the speeds of other scroll compressors to the upper speed limit. When the aforesaid difference exceeds the upper speed limit of the first scroll compressor, the speed setting unit stops the first scroll compressor, and reduces the speed of a second scroll compressor by a difference between the aforementioned difference and the upper speed limit of the first scroll compressor. Thus only some of the scroll compressors are run at a low speed while other scroll compressors are run at a high speed, whereby the specific energy of the compressed gas supply unit can be reduced.

As described above, the present invention allows for use of scroll compressors that are suited for applications where their speeds need to be changed frequently, and setting of the speed of each scroll compressor in prompt reaction to frequent load changes. Thus a compressed gas supply unit capable of stably adjusting the discharge pressure of compressed gas to a level required by the gas recipient and reducing power consumption despite frequent load changes can be realized.

Preferably, in the present invention, when the difference between the calculated sum of speeds and the sum of upper speed limits is larger than the difference between the upper speed limit and the lower speed limit of the first scroll compressor (The second difference), and smaller than the upper speed limit of the first scroll compressor, the speed setting unit sets the speed of the first scroll compressor to the lower speed limit, and reduces the speed of the second scroll compressor by a difference between the aforementioned difference and the second difference. Thereby, the number of scroll compressors run at a low speed is reduced, so that the power consumption is lower, and also the sum of speeds of all the scroll compressors can be easily matched with the calculated sum of speeds.

Oil-free scroll compressors are used in a variety of applications as they can supply clean air completely free of oil mist. On the other hand, oil-free compressors are prone to formation of a clearance in compression chambers, which lowers the compressor efficiency due to leakage of compressed gas through the clearance. This tendency is more evident during low speed operation. It is therefore preferable to set the lower speed limit for oil-free operation of scroll compressors to be higher than the lower speed limit for lubricated operation. Thereby, a drop in efficiency of the scroll compressors during oil-free operation can be prevented to suppress an increase in power consumption.

According to the present invention, the controller that modulates the speeds of the plurality of scroll compressors includes a speed range setting unit, a calculating unit that calculates the sum of speeds of the plurality of scroll compressors, and a speed setting unit that sets the speed of each scroll compressor based on the calculated sum of speeds. The controller can promptly set the speeds of the respective scroll compressors in response to frequent load changes, thereby stably adjusting the discharge pressure of compressed gas promptly to a level required by a gas recipient. Since only some of the scroll compressors are run at a low speed while other scroll compressors are run at a high speed, the specific energy of the compressed gas supply unit can be reduced.

BRIEF DESCRIPTION OF THE DRAWINGS

FIG. 2A is a chart showing a control method of the first embodiment, FIG. 2B is a chart showing a control method of a comparative example, and FIG. 2C is a chart showing a conventional method of using a single compressor and controlling its speed;

FIG. 4 is a chart showing a control method according to a second embodiment of the present invention.

DESCRIPTION OF THE PREFERRED EMBODIMENTS

The illustrated embodiments of the present invention will be hereinafter described in detail. It should be noted that, unless otherwise particularly specified, the sizes, materials, shapes, and relative arrangement or the like of constituent components described in these embodiments are not intended to limit the scope of this invention.

Embodiment 1

Figure 1:
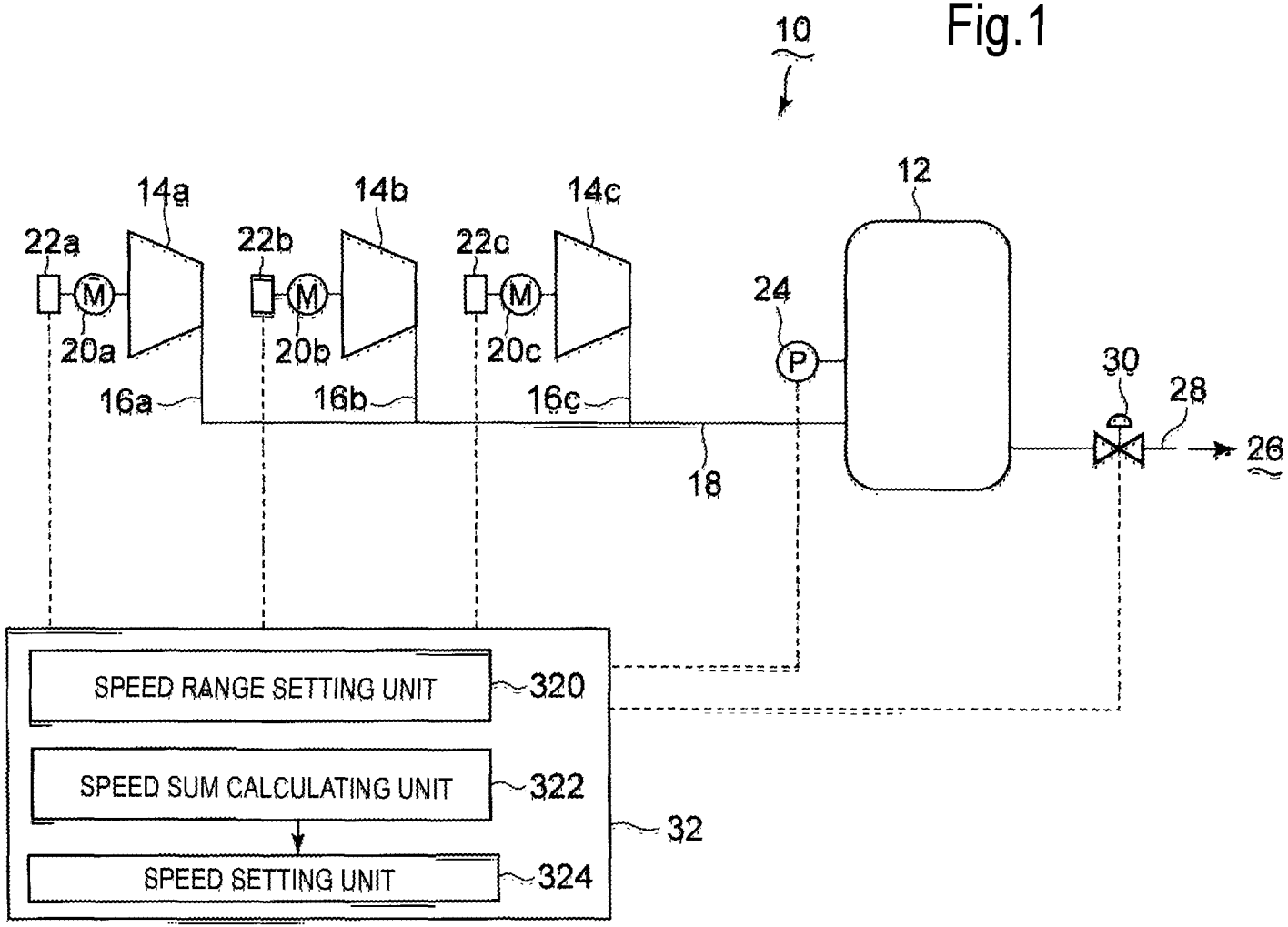
FIG. 1 is a system diagram of a compressed gas supply unit according to a first embodiment of the present invention.

A first embodiment in which the present invention is applied to a compressed gas supply unit equipped with oil-free scroll air compressors will be described with reference to FIG. 1 to FIG. 3. In FIG. 1, the compressed gas supply unit 10 includes one reservoir tank 12 and three scroll compressors 14*a* to 14*c*. The discharge passages 16*a* to 16*c* of the respective scroll compressors 14*a* to 14*c* join a main supply passage 18, which is connected to the reservoir tank 12. Compressed gas discharged from the respective scroll compressors 14*a* to 14*c* travels through the main supply passage 18 and is reserved temporarily in the reservoir tank 12.

The scroll compressors 14*a* to 14*c* each include a drive motor 20*a* to 20*c*, and an inverter device 22*a* to 22*c* that allows for independent and stepless modulation of the speed of the drive motor 20*a* to 20*c*. In the reservoir tank 12 is provided a pressure sensor 24 that detects the pressure of compressed gas inside the reservoir tank 12. A supply passage 28, with a solenoid valve 30, is provided to the reservoir tank 12 for supplying compressed gas to a gas recipient 26.

A controller 32 is located in a monitor room (not shown), and measurements from the pressure sensor 24 are sent to the controller 32. The controller 32 controls the inverter devices 22*a* to 22*c* to modulate the speeds of the scroll compressors 14*a* to 14*c*, as well as the on/off of the solenoid valve 30. The controller 32 adjusts the pressure of compressed gas in the reservoir tank 12 always to the level required by the gas recipient 26.

The controller 32 includes a speed range setting unit 320 that sets an upper speed limit and a lower speed limit of the scroll compressors 14*a* to 14*c*, a speed sum calculating unit 322 calculating a sum of speeds of the respective scroll compressors 14*a* to 14*c* based on adapted to a load of the compressed gas supply unit 10, and a speed setting unit 324 that allocates the calculated sum of speeds among the scroll compressors to set the speeds for the respective scroll compressors.

FIGS. 2A to 2C more specifically show how the scroll compressors 14*a* to 14*c* are controlled, in the present invention, with a conventional method and in a comparative example. FIGS. 2A to 2C show the speeds of the respective scroll compressors 14*a* to 14*c*, and specific energy (power consumption per unit discharge volume) of the drive motors 20*a* to 20*c* adapted to these speeds. The speeds are shown in percentage and not as absolute values. For example, "50% speed" represents the speed of the drive motor 20*a* to 20*c* that is required when the load percentage of the scroll compressors 14*a* to 14*c* is 50%. The overall speed (%) represents a value obtained by dividing the sum of speeds (%) of the scroll compressors 14*a* to 14*c* by the number of the scroll compressors 14*a* to 14*c*.

In this embodiment, the upper speed limit (100%) set by the speed range setting unit 320 is the speed of the drive motor 20*a* to 20*c* when the load percentage of the scroll compressor 14*a* to 14*c* is 100%. This prevents the speeds of the drive motors 20*a* to 20*c* from being in a range to be overloaded and maintains the motors to run correctly. The lower speed limit is provided in relation to the specific energy, as the specific energy of the drive motors 20*a* to 20*c* increases extremely in a low speed range. The speed range setting unit 320 sets a speed of 30% corresponding to the load percentage of 30% as the lower speed limit.

The speed sum calculating unit 322 calculates the sum of speeds of the respective scroll compressors 14*a* to 14*c* based on and adapted to the load percentage of the compressed gas supply unit 10. The speed setting unit 324 allocates this sum of speeds calculated by the speed sum calculating unit 322 among the scroll compressors 14*a* to 14*c*, thus setting the speeds for the respective scroll compressors 14*a* to 14*c*.

FIG. 2A is a chart showing a method of controlling the scroll compressors 14*a* to 14*c* according to the present invention. In FIG. 2A, for example, when the load percentage of the compressed gas supply unit 10 is 100%, the overall speed is 100%, too, and the sum of speeds calculated by the speed sum calculating unit 322 is 300%. The speed setting unit 324 allocates 100% of this speed sum to each of the scroll compressors 14*a* to 14*c*, thus setting the speed for each scroll compressor 14*a* to 14*c*. When the load percentage of the compressed gas supply unit 10 is 97%, the overall speed is 97%, too, and the sum of speeds is 290%. Of this speed sum, 90% is allocated to a first unit 14*a*, and 100% is allocated to second and third units 14*b* and 14*c*. As the overall load percentage decreases from 100%, the speed of only the first unit 14*a* is reduced.

As the load percentage of the compressed gas supply unit 10 lowers, the first unit 14*a* only is reduced in speed, to the lower speed limit which is 30%. When the load percentage lowers further than that, the first unit 14*a* is stopped, and if the load becomes still lower, the speed of the second unit 14*b* is reduced. For example, when the load percentage is 63%, the first unit 14*a* is stopped, and the speed of the second unit 14*b* is lowered to 90%. When the load percentage decreases further, the speed of the second unit 14*b* is reduced further. When the load percentage decreases as low as to 43% (overall speed: 43%), the speed of the second unit 14*b* is lowered to 30%, after which, if the load percentage lowers further, the second unit 14*b* is stopped, and the speed of the third unit 14*c* is reduced.

FIG. 2B shows a conventional control method wherein one scroll compressor is used and the speed of this scroll compressor is modulated. FIG. 2C shows another control method (comparative example) for a compressed gas supply unit having three scroll compressors, which does not involve start-stop control of the compressors but only the speed control of the three scroll compressors. In this comparative example, as the load percentage of the compressed gas supply unit 10 lowers, the speed of only the first unit 14*a* is reduced to the lower speed limit, which is 30%. When the load percentage lowers further, the speed of the second unit 14*b* is reduced gradually to 30%. When the load percentage lowers further, the speed of the third unit 14*c* is reduced gradually to 30%. The difference from the embodiment shown in FIG. 2A is that the speeds of the respective scroll compressors are not reduced to lower than 30%.

Figure 3:
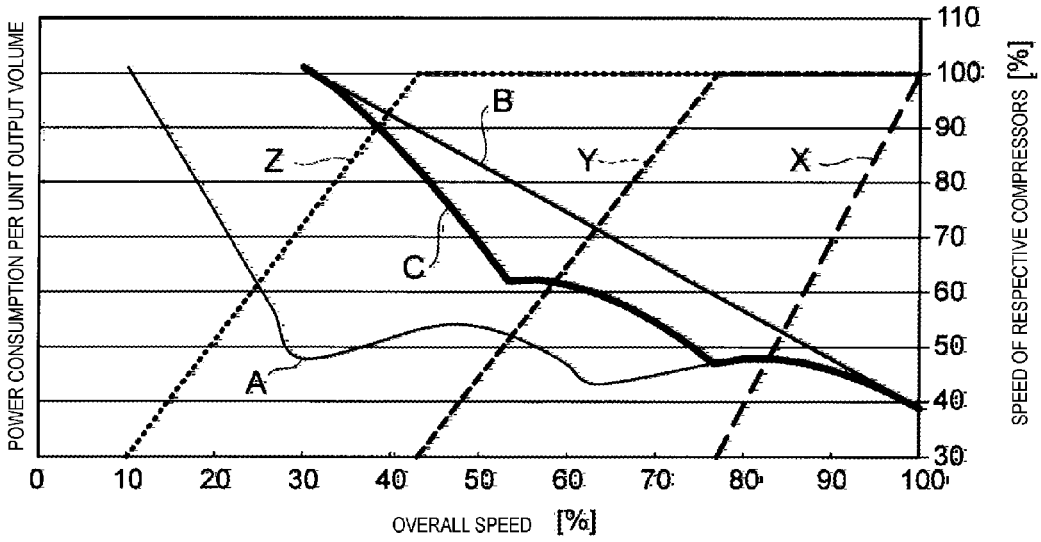
FIG. 3 is a graph showing the power consumption in the cases with the first embodiment, the comparative example, and the conventional method shown in FIGS. 2A to 2C.

FIG. 3 is a graph drawn by plotting the values shown in the charts of FIG. 2A, FIG. 2B, and FIG. 2C. The horizontal axis represents the overall speed (%), while the vertical axis represents the specific energy (power consumption per unit discharge volume) of the drive motors 20*a* to 20*c*, or the speed (%) of the respective scroll compressors 14*a* to 14*c*. The speed (%) primarily corresponds to the load percentage (%). Namely, when the load percentage is 30%, the speed is also 30%. In FIG. 3, line A indicates the control method of this embodiment, line B indicates the conventional control method shown in FIG. 2B, and line C indicates the control method of the comparative example shown in FIG. 2C. Line X represents the first unit 14*a*, line Y represents the second unit 14*b*, and line Z represents the third unit 14*c*. Data for lower than 30% is not shown, as the scroll compressors 14*a* to 14*c* are stopped when the speed becomes below 30%.

According to this embodiment, by means of the speed range setting unit 320, the speeds of the respective scroll compressors 14*a* to 14*c* are maintained in a range where the drive motors 20*a* to 20*c* run normally with low specific energy (power consumption per unit discharge volume). With the speed sum calculating unit 322, the sum of speeds of the scroll compressors 14*a* to 14*c* is calculated based on and adapted to the current load percentage of the compressed gas supply unit 10. The speed setting unit 324 allocates the calculated sum of speeds among the scroll compressors 14*a* to 14*c*, whereby the speeds of the respective scroll compressors 14*a* to 14*c* can be set in an early stage adapted to the load percentage of the compressed gas supply unit 10. Thus the compressed gas supply unit 10 can promptly adjust the discharge pressure to a desired level and stably supply the compressed gas to the gas recipient 26.

The speed setting unit 324 sets the speeds of the respective scroll compressors 14*a* to 14*c* such that only some of them are operated at a low speed, while others are maintained at a high speed, so that the specific energy of the drive motors 20*a* to 20*c* is reduced. FIG. 3 indicates that the specific energy is significantly reduced in the low speed range with the use of the control method of this embodiment represented by line A, as compared to the conventional method represented by line B and the comparative example represented by line C. With the lower speed limit of 30%, the possibility of leakage of compressed gas from the compression chambers is reduced even during oil-free operation, to achieve good efficiency of operation and suppress an increase in specific energy.

Embodiment 2

Next, a second embodiment of the present invention will be described with reference to FIG. 4. This embodiment is an example of operating the compressed gas supply unit 10 shown in FIG. 1 in a different manner. In this embodiment, the speed range setting unit 320 sets the lower speed limit $MV_{min}$ to 1000 $min^{-1}$, and the upper speed limit $MV_{max}$ to 3000 $min^{-1}$.

In this embodiment, the sum of the upper limit speeds of the scroll compressors 14*a* to 14*c* is 9000 $min^{-1}$. When the speed sum is lowered from 9000 $min^{-1}$ to 8500 $min^{-1}$, the speed of the third unit 14*c* is reduced from 3000 $min^{-1}$ to 2500 $min^{-1}$. Namely, as the speed sum lowers, the speed of only the third unit 14*c* is reduced. After the speed of the third unit 14*c* reaches the lower speed limit $MV_{min}$, when the speed sum further lowers by 500 $min^{-1}$, the speed of the second unit 14*b* is lowered by 500 $min^{-1}$. When the overall speed further lowers by 500 $min^{-1}$, the speed of the second unit 14*b* is returned to 3000 $min^{-1}$, and the third unit 14*c* is stopped. When the overall speed further lowers, this time around, the speed of the second unit 14*b* is reduced.

According to this embodiment, in addition to the advantageous effects of the first embodiment, the number of scroll compressors run at low speeds is minimized to reduce the specific energy of the drive motors 20*a* to 20*c*, while it is made easy to modulate the sum of speeds of all the scroll compressors 14*a* to 14*c* to the calculated sum of speeds determined by the speed sum calculating unit 322.

According to the present invention, a constant discharge pressure is maintained to achieve stable operation and power consumption is reduced despite frequent load changes in a compressed gas supply unit having a plurality of scroll compressors.

What is claimed is:

1. A compressed gas supply unit, comprising: a plurality of scroll compressors, an inverter device allowing independent modulation of speeds of the respective scroll compressors, a merge pipe or a reservoir tank for collecting gas discharged from the plurality of scroll compressors, a pressure sensor detecting discharge pressure of the plurality of scroll compressors, and a controller controlling the inverter device for modulating the speeds of the respective scroll compressors, the controller including a speed range setting unit that sets an upper speed limit and a lower speed limit of the respective plurality of scroll compressors, a calculating unit that calculates a sum of speeds of the plurality of scroll compressors based on a load of the compressed gas supply unit, and a speed setting unit that allocates the calculated sum of speeds among the scroll compressors to set speeds for the respective scroll compressors, wherein when the sum of speeds calculated by the calculating unit is lower than a sum of upper speed limits of all the scroll compressors, the speed setting unit reduces the speed of a first scroll compressor by a first difference between the calculated sum of speeds and the sum of upper speed limits, and sets the speeds of the other scroll compressors to the upper speed limit, and when the first difference exceeds the upper speed limit of the first scroll compressor, the speed setting unit stops the first scroll compressor, and reduces the speed of a second scroll compressor by a difference between the first difference and the upper speed limit of the first scroll compressor.

2. The compressed gas supply unit according to claim 1, wherein when the first difference is larger than a second difference between the upper speed limit and the lower speed limit of the first scroll compressor, and smaller than the upper speed limit of the first scroll compressor, the speed setting unit sets the speed of the first scroll compressor to the lower speed limit, and reduces the speed of the second scroll compressor by a difference between the first difference and the second difference.

3. The compressed gas supply unit according to claim 1, wherein the speed range setting unit sets a lower speed limit for oil-free operation of the scroll compressors to be higher than a lower speed limit for lubricated operation.

4. The compressed gas supply unit according to claim 3, wherein the lower speed limit for oil-free operation of the scroll compressors is set to a speed adapted to a load percentage of 30% of the scroll compressors.

* * * * *